United States Patent [19]

Villa

[11] Patent Number: 4,541,461

[45] Date of Patent: Sep. 17, 1985

[54] RIBBON LOOM

[75] Inventor: Carlo Villa, Melzo, Italy

[73] Assignee: Textilma AG, Hergiswil, Switzerland

[21] Appl. No.: 586,322

[22] Filed: Mar. 5, 1984

[30] Foreign Application Priority Data

Mar. 16, 1983 [CH] Switzerland ..... 1451/83

[51] Int. Cl.[4] ..... D03D 51/40

[52] U.S. Cl. ..... 139/442; 139/453

[58] Field of Search ..... 139/116, 117, 440, 441, 139/442, 453

[56] References Cited

U.S. PATENT DOCUMENTS 639,018 12/1889 Brun ..... 139/440

4,421,142 12/1983 Muller ..... 139/117

*Primary Examiner*—Henry S. Jaudon

*Attorney, Agent, or Firm*—Werner W. Kleeman

[57] ABSTRACT

The ribbon loom comprises a weft thread insertion needle arranged at one side of the warp threads for inserting at least one loop or bight of a weft thread into the weaving or loom shed formed by the warp threads. The weft thread insertion needle has a longitudinal slit throughout almost its entire length. The weft thread insertion needle is also provided with a hook which, exterior to the longitudinal slit, is located at least approximately in the plane of motion of the weft thread insertion needle and is oriented toward the thread guide for the weft threads. The tip or point of the hook is arranged in the proximity of the free end of the weft thread insertion needle and points toward such free end. This results in an especially slender design of weft thread insertion needle and a reliable engagement of the weft thread or threads on the hook solely by means of the thread guide without any supplementary or auxiliary device.

8 Claims, 5 Drawing Figures

RIBBON LOOM

BACKGROUND OF THE INVENTION

The present invention broadly relates to power looms and, more specifically, pertains to a new and improved construction of a ribbon or tape weaving machine or loom for weaving ribbons or tapes or the like.

Generally speaking, the ribbon loom or weaving machine of the present invention is of the type comprising a weft thread insertion needle arranged at the side of the warp threads for inserting a weft thread loop or bight into the weaving shed. The weft thread insertion needle has a longitudinal slit or slot extending over substantially the entire extent of its length for accommodating therein at least two weft threads and also has a hook structure or hook arranged in the region of its free needle end. The hook structure is provided with a tip or point oriented in the direction of the free end of the weft thread insertion needle. Thread guides serve for holding the at least two weft threads in selected and non-selected or idle positions, such that the weft threads can be picked up by the weft thread insertion needle and inserted or fed into the weaving or loom shed.

A ribbon loom or weaving machine of this type is known from German Patent No. 2,400,101. In such ribbon loom, the plane of the opening of the longitudinal slit of the weft thread insertion needle is arranged transverse to the plane of motion of such weft thread insertion needle and the hook is disposed within the longitudinal slit on an edge of an arm or leg of the material surrounding the slit. Although very good results have been obtained with this weft thread insertion needle, it has the disadvantage that guide pins are required to guide the weft threads so as to ensure the proper insertion of one or more of them. The further disadvantage arises that the weft thread can jump off the hook. Due to the arrangement of the hook within the longitudinal slit, it is furthermore necessary that the weft thread insertion needle have a relatively large width which, in turn, requires a relatively large weaving shed. The greater displacements or sweeps of the corresponding warp harnesses necessary to open the weaving shed require correspondingly larger drive means whose rotational speed is limited. This limits the performance or output of such ribbon looms.

SUMMARY OF THE INVENTION

Therefore, with the foregoing in mind it is primary object of the present invention to provide a new and improved construction of a loom or weaving machine which does not have associated with it the aforementioned drawbacks and shortcomings of the prior art constructions.

Another and more specific object of the present invention aims at providing a new and improved construction of a ribbon loom or weaving machine of the previously mentioned type in which the hook is arranged exterior to the longitudinal slit or slot of the weft thread insertion needle and at least approximately in the plane of motion of the weft thread insertion needle and oriented toward the thread guide means.

Yet a further significant object of the present invention aims at providing a new and improved construction of a power ribbon loom of the character described which is relatively simple in construction and design, extremely economical to manufacture, highly reliable in operation and affords a high output, not readily subject to breakdown and malfunction and requires a minimum of maintenance and servicing.

Now in order to implement these and still further objects of the invention, which will become more readily apparent as the description proceeds, the ribbon loom of the present invention is manifested by the features that the hook structure or hook is arranged exterior to the longitudinal slit at least approximately in the plane of motion of the weft thread insertion needle and is oriented or directed toward the thread guides for the warp threads.

By virtue of the fact that the hook is arranged externally of the longitudinal slit or slot of the weft thread insertion needle and at least approximately in the plane of motion or movement of the weft thread insertion needle and is oriented or directed toward the thread guides, the hook does not limit or define the opening of the longitudinal slit, so that the latter may be made considerably more slender or narrower. This means that only the guidance of the weft thread or threads need be taken into consideration. A narrower longitudinal slit or slot results in a more slender weft thread insertion needle. This means that the weaving shed need not be opened so wide and therefore that smaller sweeps or displacements of the corresponding warp harnesses are sufficient. This permits the use of smaller and faster drive means which can increase the performance or output of such ribbon looms.

The arrangement of the hook externally of the longitudinal slit and oriented in the direction of the thread guides as well as the accurate guidance of the weft threads within the longitudinal slit make the use of guide pins or the like in such ribbon or tape looms superfluous. Reliable operation of the weft thread insertion needle is still assured by the improved thread guidance. Furthermore, an undesirable disengagement or jumping off of the weft threads from the hook of the weft thread insertion needle is avoided.

In the new and improved arrangement, the plane of the opening of the longitudinal slit or slot of the weft thread insertion needle can coincide with the plane of motion of the needle. This results in an especially flat design of the weft thread insertion needle which, in turn, results in a particularly small weaving shed and consequently permits a very high performance or output of the ribbon loom or weaving machine. On the other hand, the weft threads are subjected to a very taut guidance in the longitudinal slit, so that there are limits to crossing a weft thread to be inserted into the shed with another weft thread in the selected position. Compromise designs of the weft thread insertion needle are also possible in which the plane of opening of the longitudinal slit forms an angle of between 0° and 90° to the plane of motion of the weft thread insertion needle. However, an embodiment of the ribbon loom in which the plane of opening of the longitudinal slit is transverse to the plane of motion of the needle is particularly advantageous, since in this case the weft threads can more easily cross one another in the longitudinal slit. In this arrangement, the hook can be disposed on the upper or the lower arm of the weft thread insertion needle, according to whether the thread guides move upwardly or downwardly in their travel to the selected position.

A particularly slender and stable construction of the weft thread insertion needle results when at least one arm or leg of the needle which carries the hook is substantially rectangular in cross section and its major axis lies substantially in the plane of motion of the needle and the hook is preferably formed by an acute-angled step in the width of the arm, i.e. by a step-like taper or constriction of the front portion of the weft thread insertion needle. This permits the other hook-free arm or leg of the weft thread insertion needle to be lightly constructed, for instance preferably from a piece of wire.

BRIEF DESCRIPTION OF THE DRAWINGS

The invention will be better understood and objects other than those set forth above, will become apparent when consideration is given to the following detailed description thereof. Such description makes reference to the annexed drawings wherein.

DETAILED DESCRIPTION OF THE PREFERRED EMBODIMENTS

Figure 1:
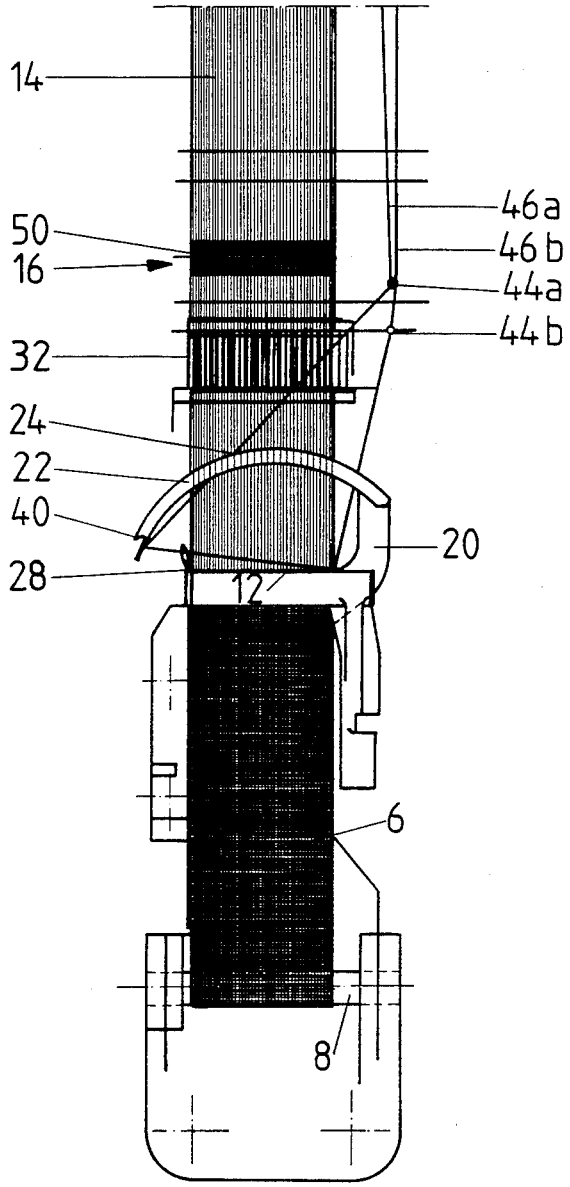
FIG. 1 schematically illustrates in fragmentary section and in top plan view a ribbon loom or weaving machine according to the invention.
Figure 2:
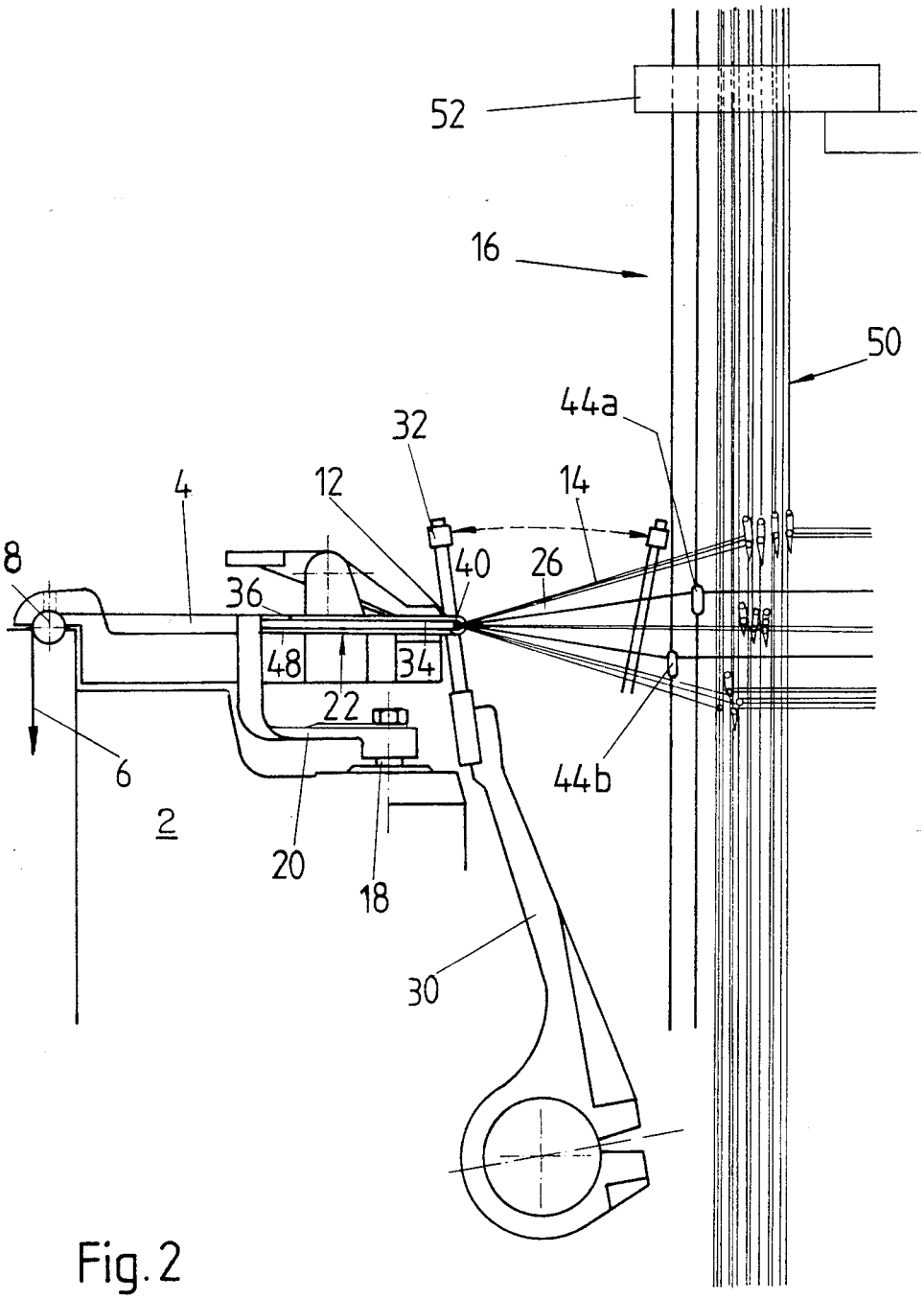
FIG. 2 schematically illustrates the ribbon loom according to FIG. 1 in side view.

Describing now the drawings, it is to be understood that only enough of the construction of the ribbon or tape weaving machine or loom has been depicted therein as is needed for those skilled in the art to readily understand the underlying principles and concepts of the present development, while simplifying the showing of the drawings. Turning attention now to FIGS. 1 to 4, it will be seen that the exemplary embodiment of ribbon or tape weaving machine or loom comprises a support plate 4 mounted on a loom frame 2 for supporting and guiding the woven goods or fabric 6. A breast roll 8 is mounted at the outer or front end of the support plate 4. The woven goods 6 pass over the breast roll 8 to a conventional fabric or woven goods roll not particularly shown in the drawings. The inner or rear end of the support plate 4 guides and retains the fabric 6 at the beat-up edge or cloth fell 12. A suitable warp thread supply device feeds the warp threads 14 through a shed-forming device 16 to the beat-up edge or cloth fell 12.

The loom frame 2 is provided with a not particularly shown but suitable drive mechanism which drives a shaft 18 in rotary oscillation. An arm or arm member 20 is mounted on the shaft 18 and carries a weft thread insertion needle 22. The weft thread insertion needle 22 introduces or inserts one or more weft thread loops or bights 24 into the weaving shed 26 formed by the warp threads 14. On the side of the weaving shed 26 opposite the weft thread insertion needle 22, a knitting or chaining needle 28 driven with a to-and-fro motion is arranged to lock or tie the weft thread loops or bights 24 fed in by the weft thread insertion needle 22. Sequential or successive weft thread loops or bights 24 can be chained with one another or can be knitted or tied by an auxiliary thread. A weaving reed 32 mounted on a pivot or pivotal arm 30 serves to beat-up the inserted weft thread loops or bights against the beat-up edge or fell 12.

Figure 3:
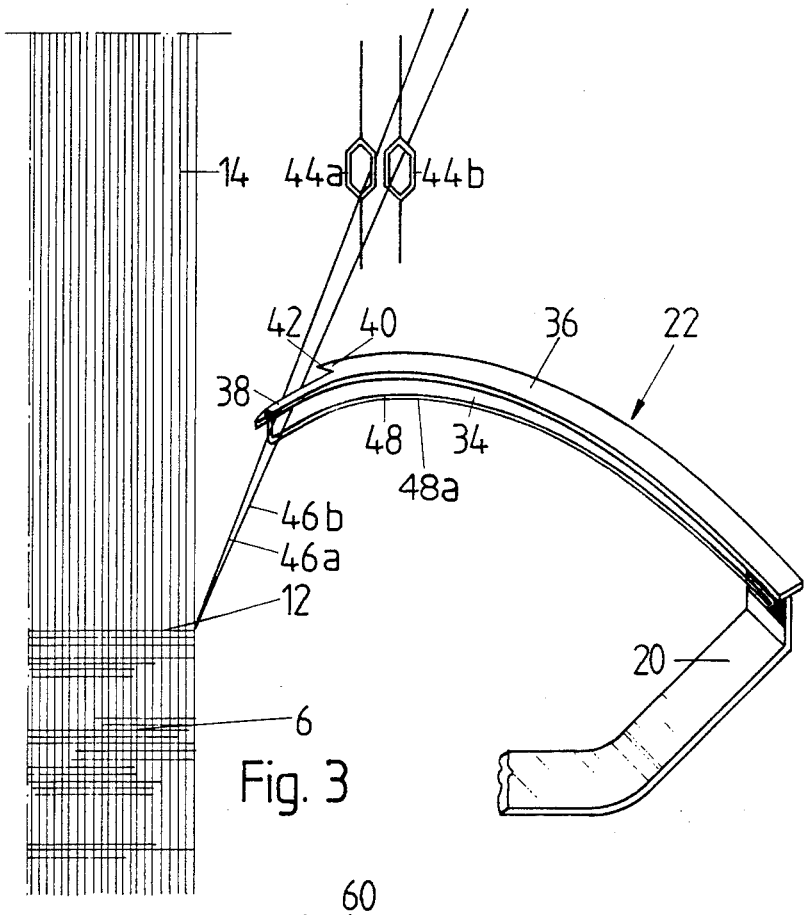
FIG. 3 schematically illustrates in detail the weft thread insertion needle of the ribbon loom on a larger scale.

As best seen by referring to FIG. 3, the weft thread insertion needle 22 is provided with a longitudinal slit or slot 34 whose plane of opening is transverse to the plane of motion or movement of the weft thread insertion needle 22. This longitudinal slit 34 is formed by two surrounding arms or legs 36 and 48, the upper arm 36 having a substantially rectangular cross section whose major axis lies in the plane of motion of the needle. A hook or hook member 40 is formed on the upper arm 36 in proximity to the free end of the weft thread insertion needle 22. This upper arm 36 is provided with a segment or constriction 38 reduced in width in respect to the cross section of the arm by an acute-angled step or step-like taper forming the hook 40. The tip or point 42 of the hook 40 is oriented toward the free end of the weft thread insertion needle 22 and also toward thread guides **44*a* and 44*b* for the weft threads 46*a* and 46*b***, respectively.

The lower arm or leg 48 of the weft thread insertion needle 22 bordering and limiting the longitudinal slit or slot 34 is less rigid or sturdy than the upper arm or leg 36 and is preferably formed of a wire **48*a*. A plurality of weft threads 46*a*, 46*b* can be guided in the longitudinal slit or slot 34. In the drawings, only two weft threads are shown. In the non-selected or idle position of the thread guides 44*a*, 44*b*, the weft threads 46*a*, 46*b* lie upon the lower edge of the longitudinal slit 34, i.e. on the lower arm or leg 48, as is visible in FIG. 3 and especially visible for weft thread 46*b* in FIG. 4. This places the weft threads 46*a*, 46*b* beyond the engagement region of the hook 40. If a thread guide 44*a* or 44*b* (specifically thread guide 44*a* in FIG. 4) is now raised into the selected position, the corresponding weft thread 46*a* or 46*b* (specifically weft thread 46*a* in FIG. 4) is guided diagonally upward into the engagement region of the hook 40. The weft thread that is momentarily engaged by the hook 40 is fed into the weaving shed 26 in the form of a loop or bight 24 by the weft thread insertion needle 22 and is held and tied or stitched by the knitting needle 28** on the opposite side of the woven ribbon or tape or the like.

To select the weft thread to be inserted into the shed 26 from a plurality of weft threads **46*a*, 46*b* guided in the longitudinal slit 34, any known programmable device can be provided. This can be, for instance, a cam device or similar structure. The weft thread selection can also be made by the shed forming device, for instance a heald machine, a single heddle control or a Jacquard loom. The latter is shown in the present illustrative example and its heddle set or buddle 50 is visible, guided through the holes of a stringing board 52** or the like.

Figure 5:
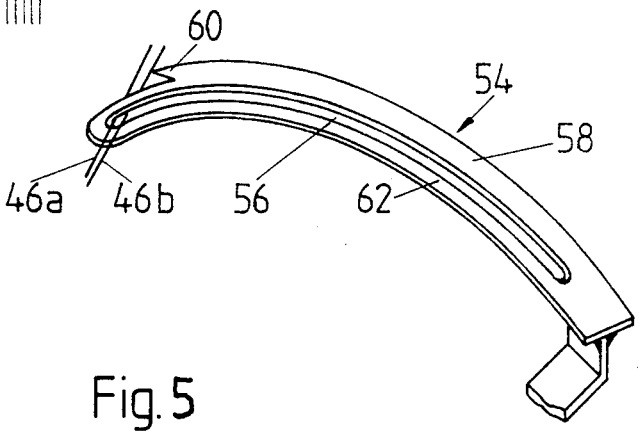
FIG. 5 is a schematic representation of a further construction of a weft thread insertion needle similar to the showing of FIG. 3.
Figure 4:
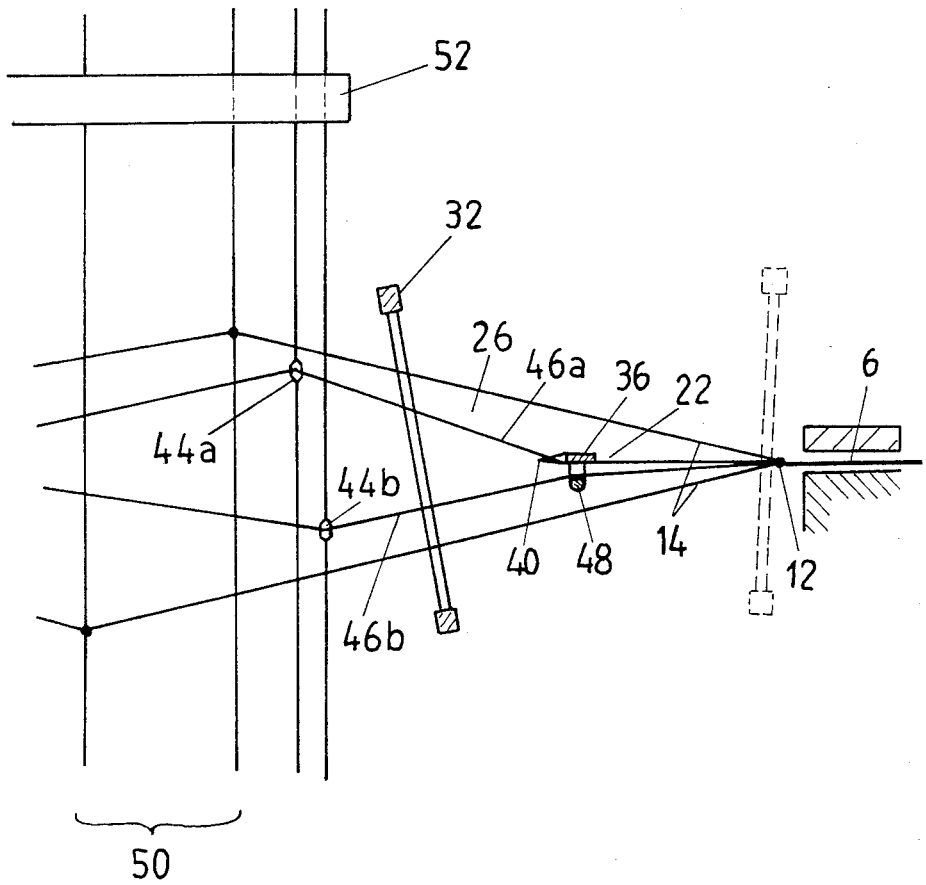
FIG. 4 is a schematic side view of the loom according to FIG. 2 seen from the side opposite that in FIG. 2 and showing the weaving reed in retracted position to permit the weft thread to be inserted.

FIG. 5 shows a further embodiment of weft thread insertion needle 54 which, in contrast to the weft thread insertion needle 22 of FIGS. 3 and 4, is provided with a longitudinal slit 56, the plane of whose opening lies in the plane of motion of the weft thread insertion needle 54. A hook or hook member 60 is arranged on the rearward arm or leg 58 defining one side of the longitudinal slit 56. The hook 60 is arranged and structured analogously to the hook 40 of the weft thread insertion needle 22. The forward arm or leg 62 defining or bounding the other edge of the longitudinal slit or slot 56 of the weft thread insertion needle 54 is, in this embodiment, likewise structured to be less rigid or sturdy than the rearward arm 58. The operation of this weft thread insertion needle 54 in inserting the weft threads 46*a* and/or 46*b* corresponds to the procedures described above.

Still further embodiments of the weft thread insertion needle are possible. For instance, combined forms of the weft thread insertion needles 22 and 54 are conceivable, i.e. the plane of the opening of the longitudinal slits can, as required, be oriented at an angle varying between 0° and 90° to the plane of motion of the weft thread insertion needle. Furthermore, the weft thread insertion needle need by no means be curved. Straight needles having straight-line to-and-fro motions are also possible.

While there are shown and described present preferred embodiments of the invention, it is to be distinctly understood that the invention is not limited thereto, but may be otherwise variously embodied and practiced within the scope of the following claims.

What I claim is:

1. A power loom, especially a ribbon loom for weaving ribbins, comprising:

a weft thread insertion needle arranged at one side of warp threads and having a plane of motion for inserting at least one weft thread loop into a shed of the warp threads;

said weft thread insertion needle having a length and a free end;

said weft thread insertion needle having a longitudinal slit extending over substantially the entire extent of said length for accommodating at least two weft threads;

said longitudinal slit having opposite ends;

said longitudinal slit being closed at each of said opposite ends thereof;

said weft thread insertion needle having a hook structure arranged in the region of said free end;

said hook structure being provided with a point oriented in the direction of the free end of the weft thread insertion needle;

thread guides for holding said at least two weft threads in selected and non-selected positions such that said at least two weft threads can be picked up by the weft thread insertion needle and inserted into said shed; and said hook structure being arranged exterior to said longitudinal slit, at least approximately in said plane of motion of the weft thread insertion needle and oriented toward said thread guides for the warp threads.

2. The power ribbon loom as defined in claim 1, wherein:

said longitudinal slit defines an opening; and a plane of said opening of said longitudinal slit being located in the plane of motion of said weft thread.

3. The ribbon loom as defined in claim 1, further including:

an upper arm bordering at said longitudinal slit; and said upper arm being provided with said hook and having an at least approximately rectangular cross section and possessing a major axis lying at least approximately in the plane of motion of said weft thread insertion needle.

4. The ribbon loom as defined in claim 5, wherein:

said hook is formed by a stepped reduction in the width of a forward part of the weft thread insertion needle.

5. A power loom, especially a ribbon loom for weaving ribbons, comprising:

a weft thread insertion needle arranged at one side of warp threads and having a plane of motion for inserting at least one weft thread loop into a shed of the warp threads;

said weft thread insertion needle having a length and a free end;

said weft threat insertion needle having a longitudinal slit extending over substantially the entire extent of said length for accommodating at least two weft threads;

said weft thread insertion needle having a hook structure arranged in the region of said free end;

said hook structure being provided with a point oriented in the direction of the free end of the weft thread insertion needle;

thread guides for holding said at least two weft threads in selected and non-selected positions such that said at least two weft threads can be picked up by the weft thread insertion needle and inserted into said shed;

said hook structure being arranged exterior to said longitudinal slit, at least approximately in said plane of motion of the weft thread insertion needle and oriented toward said thread guides for the warp threads;

said longitudinal slit defining an opening; and a plane of said opening of said longitudinal slit lying at least approximately transverse to the plane of motion of said weft thread insertion needle.

6. The ribbon loom as defined in claim 5 wherein:

said hook is arranged on an upper arm bordering at said longitudinal slit.

7. A power loom, especially a ribbon loom for weaving ribbons, comprising:

a weft thread insertion needle arranged at one side of warp threads and having a plane of motion for inserting at least one weft thread loop into a shed of the warp threads;

said weft thread insertion needle having a length and a free end;

said weft thread insertion needle having a longitudinal slit extending over substantially the entire extent of said length for accommodating at least two weft threads;

said weft thread insertion needle having a hook structure arranged in the region of said free end;

said hook structure being provided with a point oriented in the direction of the free end of the weft thread insertion needle;

thread guides for holding said at least two weft threads in selected and non-selected positions such that said at least two weft threads can be picked up by the weft thread insertion needle and inserted into said shed;

said hook structure being arranged exterior to said longitudinal slit, at least approximately in said plane of motion of the weft thread insertion needle and oriented toward said thread guides for the warp threads;

said hook being arranged at an upper arm bordering at said longitudinal slit; and a further arm being provided for said weft thread insertion needle; and said further arm being devoid of a hook and structured to be less rigid than said upper arm.

8. The ribbon loom as defined in claim 7, wherein:

said further arm is formed by a wire.

* * * * *

UNITED STATES PATENT AND TRADEMARK OFFICE

CERTIFICATE OF CORRECTION

PATENT NO. : 4,541,461

DATED : September 17, 1985

INVENTOR(S) : CARLO VILLA

It is certified that error appears in the above—identified patent and that said Letters Patent is hereby corrected as shown below:

Column 4, line 53, please delete "buddle" and insert --bundle--

Column 5, line 20, please delete "ribbins" and insert --ribbons--

Signed and Sealed this

*Seventeenth* Day of *December 1985*

[SEAL]

*Attest:*

DONALD J. QUIGG

*Attesting Officer*

*Commissioner of Patents and Trademarks*